US009908596B2

(12) United States Patent
Watson

(10) Patent No.: US 9,908,596 B2
(45) Date of Patent: Mar. 6, 2018

(54) WATERCRAFT SKEG RETAINING DEVICE

(71) Applicant: John C. Watson, West Hills, CA (US)

(72) Inventor: John C. Watson, West Hills, CA (US)

( * ) Notice: Subject to any disclaimer, the term of this patent is extended or adjusted under 35 U.S.C. 154(b) by 0 days.

(21) Appl. No.: 15/368,042

(22) Filed: Dec. 2, 2016

(65) Prior Publication Data

US 2017/0158294 A1 Jun. 8, 2017

Related U.S. Application Data

(60) Provisional application No. 62/262,586, filed on Dec. 3, 2015.

(51) Int. Cl.
*B63B 35/79* (2006.01)
*B63B 35/73* (2006.01)

(52) U.S. Cl.
CPC ..... *B63B 35/793* (2013.01)

(58) Field of Classification Search
CPC ..... B63B 1/00; B63B 35/73; B63B 35/79; B63B 35/793; B63B 35/7926; B63B 35/85
USPC ..... 441/79
See application file for complete search history.

(56) References Cited

U.S. PATENT DOCUMENTS

| | | | | |
|---|---|---|---|---|
| 4,044,416 | A | 8/1977 | Brewer | |
| 4,398,485 | A | 8/1983 | Diziere | |
| 4,701,144 | A | 10/1987 | DeWitt, III | |
| 4,846,745 | A * | 7/1989 | Lobe | B63B 35/793 441/79 |
| 4,964,826 | A * | 10/1990 | Lobe | B63B 35/793 441/79 |
| 5,215,488 | A * | 6/1993 | Bailey | B63B 35/793 441/79 |
| 5,503,581 | A | 4/1996 | McCullough | |
| 5,934,962 | A | 8/1999 | Daum | |
| 5,934,963 | A | 8/1999 | Frizzel | |
| 6,695,662 | B2 | 2/2004 | Kelley | |
| 6,764,364 | B1 | 6/2004 | Hickman | |
| 6,793,548 | B2 | 9/2004 | Jolly | |
| 6,821,173 | B2 | 11/2004 | McCausland | |
| 6,991,504 | B1 | 1/2006 | English | |
| 7,285,031 | B2 | 10/2007 | Mair | |
| 8,096,848 | B2 | 1/2012 | Posner | |
| 8,845,373 | B2 | 9/2014 | Lausman | |
| 2013/0144933 | A1 | 6/2013 | Hinni et al. | |
| 2013/0303040 | A1 | 11/2013 | Schweikert | |

FOREIGN PATENT DOCUMENTS

| | | |
|---|---|---|
| DE | 3307412 C2 | 6/1988 |
| WO | WO 2004/035377 | 4/2004 |
| WO | WO 2015/135034 | 9/2015 |

* cited by examiner

*Primary Examiner* — Lars A Olson
(74) *Attorney, Agent, or Firm* — Cislo & Thomas, LLP; Kelly W. Cunningham

(57) ABSTRACT

A device comprising a substantially vertical post member that can be adjusted longitudinally within a fin box and remain vertical, riding adjustably in a longitudinally oriented slot and thereby protrudes from the bottom of a standard fin box customarily installed in personal watercraft such as a surfboard, sailboard, paddleboard, and the like. The securable end of a removable fin is dropped over the post and held in place by a nut, clip, hook, or clamp.

16 Claims, 5 Drawing Sheets

WATERCRAFT SKEG RETAINING DEVICE

CROSS-REFERENCES TO RELATED APPLICATIONS

This patent application claims the benefit of U.S. Provisional Application No. 62/262,586, filed on Dec. 3, 2015, which is incorporated herein by this reference thereto.

BACKGROUND OF THE INVENTION

The present invention relates to a device for securely yet releasably retaining a detachable fin or skeg to a watercraft, and more particularly for making the method of attaching and releasing the skeg user-friendly, quick, and easy.

SUMMARY OF THE INVENTION

One embodiment of the present invention comprises a cross-pin or cross-plate connected to a vertical post. The cross-pin or plate is configured to reside in the horizontal slots in the sidewalls of a standard box in a common commercially available surfboard, paddleboard, and other watercraft. The vertical post is configured to receive a standard post hole in the insert tab of a common commercially available skeg or fin. In this embodiment of the present invention, the fin is thereby securely attached to the watercraft with the fin tab being locked in the slot of the watercraft box. The device may optionally have also a movable hook or snap member that reaches around a portion of the insert tab to further secure the fin in to the board and that may be removed from the insert tab when the user wishes to release the fin from the board.

DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

One of the standard means of retaining a skeg, or fin, to a personal watercraft such as a surfboard, sailboard, paddleboard, or the like, consists of a longitudinally set box, a fin box, designed to receive fins of different sizes and shapes. Fins made for these systems generally have a cross-pin at one end of the base of the fin, and a tab at the other end of the base of the fin. The tab end customarily has a screw hole, and in order to securely attach the tab end of the fin within the fin box, the user must peer down the small screw hole, work to locate a plate at the bottom of the box, line up the hole in the fin with a hole formed in the plate, drop in a screw, and tighten the screw with a screwdriver into the hole once the hole is located in the plate. This can be quite difficult, especially in low light situations and in cold, wet, or windy environments, and the screw and/or plate are easily lost.

One embodiment of the present invention is a retaining device for releasably attaching and retaining the skeg to the watercraft in a more user-friendly way. The device of this embodiment has body portion, a post member that extends substantially vertically from the body portion, and an engaging member that extends substantially laterally from the body portion. The laterally extending member extends into a slot or ridge that is customarily formed in the sidewalls of standard fin boxes allowing the retaining device to slide longitudinally within the fin box to suit the size of the selected removable fin and position the post just right to receive the hole in the tab end of the fin. Optionally, the retaining device may also have an articulating or hinging clip, hook, or clamp that can be place around a portion of the tab end of the fin and hold the fin tab down to securely retain the fin and then moved away from the tab end to allow the fin to be quickly released from the fin box in a user friendly manner.

Figure 1:
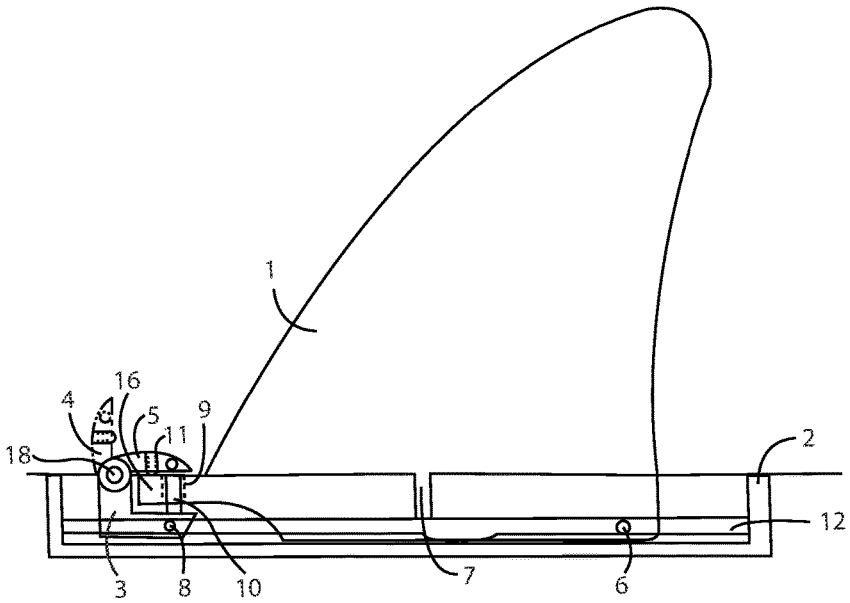
FIG. 1 shows a cutaway side view of a fin mounted into a standard fin box with one embodiment of the invention in open and closed position.
Figure 2:
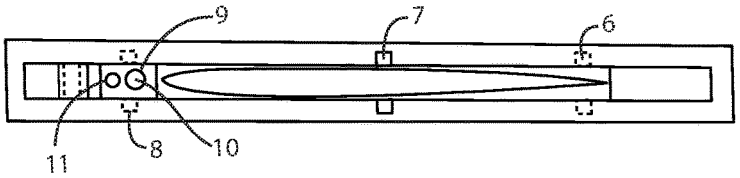
FIG. 2 shows a top view of a fin mounted in a fin box with the embodiment in closed position
Figure 3:
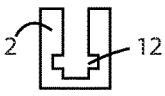
FIG. 3 shows a vertical cross-section of a standard fin box.

FIG. 1 illustrates a side cutaway view of a standard fin box 2, into which a fin has been inserted. One embodiment of the present invention is shown in position to engage the tab portion 16, of the fin 1. A vertical slot 7 is provided in the standard fin box to allow access to a longitudinal slot 12 near the bottom of the fin box 2 provided to adjustably retain cross-pin 6 of fin 1, as well as a threaded plate 14 that, customarily, receives a set screw (not shown) that has been inserted into it through hole 9 in fin tab 16 (but which is replaced in many embodiments of the present invention). Instead, in many embodiments, a retaining device 3 is inserted into the fin box 2, by slipping cross-pin 8 or other such laterally extending member located in the lower jaw of the device 3 into vertical slot 7 and slid to a preferred position along longitudinal slot 12. When the device is placed in the desired position, the tab end 16 of fin 1 can be pivoted downward, and the hole 9 in fin tab 16 is aligned with the vertical locator post 10 and dropped down onto post 10. In this embodiment, the upper end of vertical post 10 forms a ball shape. The device may also have an upper jaw or hook that hinges about a flexible region or articulates about a pintle 18, shown in open position 4, and in closed position 5, and engages the ball end of vertical post 10 by means of a socket. In this embodiment, a grub screw 11 is used in the upper jaw to exert force on fin tab 16 to take up any play resulting from slight differences in fin manufacture, and can also be used with a tool to pry open the upper jaw of the device 3.

Figure 4:
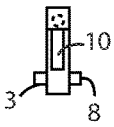
FIG. 4 shows a front view of the embodiment.
Figure 5:
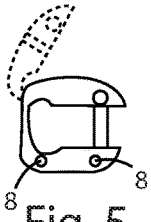
FIG. 5 shows a side view of a flex-hinged embodiment of the invention in open and closed position.
Figure 6:
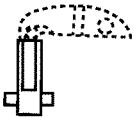
FIG. 6 shows a flex-hinged embodiment in open position, where top portion moves in a horizontal plane.

FIG. 4 shows the above described device as view from the front, with ball and socket in dashed line. FIG. 5 shows an embodiment of the invention that employs a flexible hinge to articulate the upper and lower jaws. FIG. 6 shows an embodiment of the invention that employs a flexible hinge to articulate the upper and lower jaws of the invention, but engages the vertical post 10 from the side.

Figure 7:
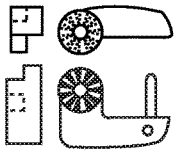
FIG. 7 shows exploded side and back views of an embodiment that uses detent teeth in the mating surfaces of the hinge knuckle.

FIG. 7 shows an exploded view of another embodiment of the invention that uses detent teeth on the on hinge-articulated jaws to help secure the upper jaw to the vertical post 10.

Figure 8:
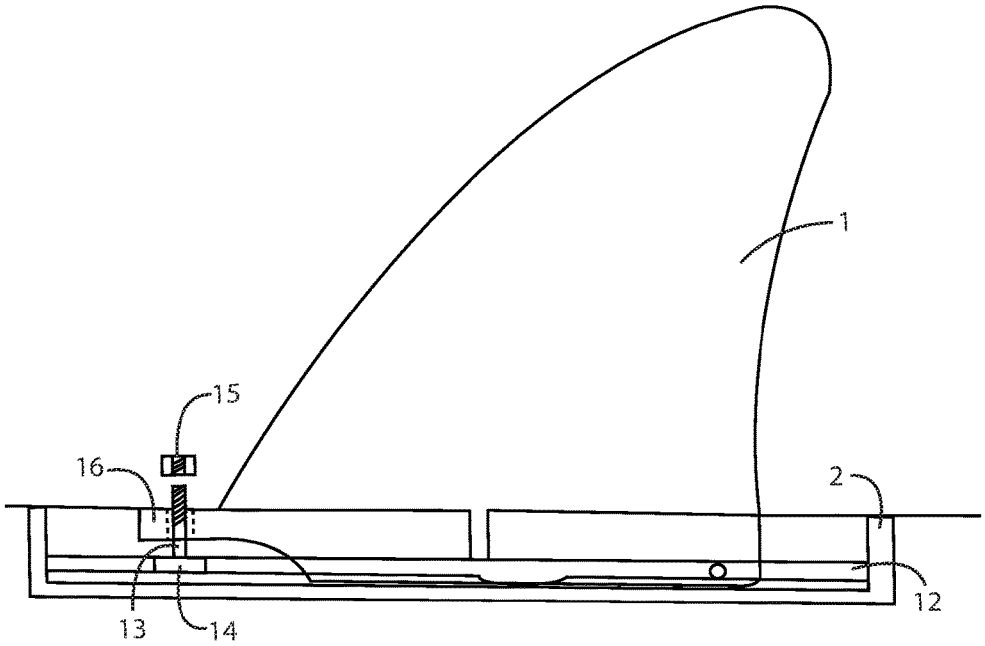
FIG. 8 shows a cutaway side view of a fin mounted in a standard fin box showing an exploded view of one embodiment of the invention.
Figure 9:
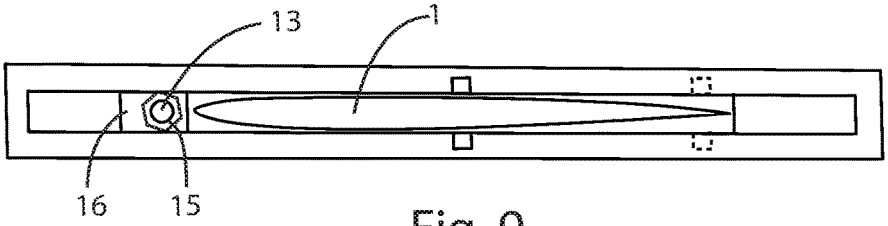
FIG. 9 shows a top view of a fin mounted in a fin box and top view of the embodiment of FIG. 8.
Figure 10:
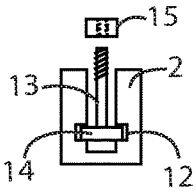
FIG. 10 shows an exploded view of the embodiment of FIG. 8 positioned in vertical cross-section of a standard fin box.

FIG. 8 shows a side cutaway view of a standard fin box 2, and another embodiment of the invention that consists of a vertical post 13 formed, machined, or otherwise fixedly attached to a plate 14 which engages the longitudinal slot 12 in fin box 2 which can be slid to a the desired position and is engaged by pivoting fin 1 onto vertical post 13. In the embodiment shown in FIGS. 8 through 10, the upper portion of vertical post 13 is threaded to accept a nut 15 to allow user to secure fin tab 16 to box 2. The nut 15 could be of any appropriate configuration, and preferably be non-corrosive. Alternatively, a post could be drilled for a clevis, or grooved for a clip. Alternatively, the member that slides in longitudinal groove 12 could incorporate a cross-pin or multiple cross-pins.

Figure 11:
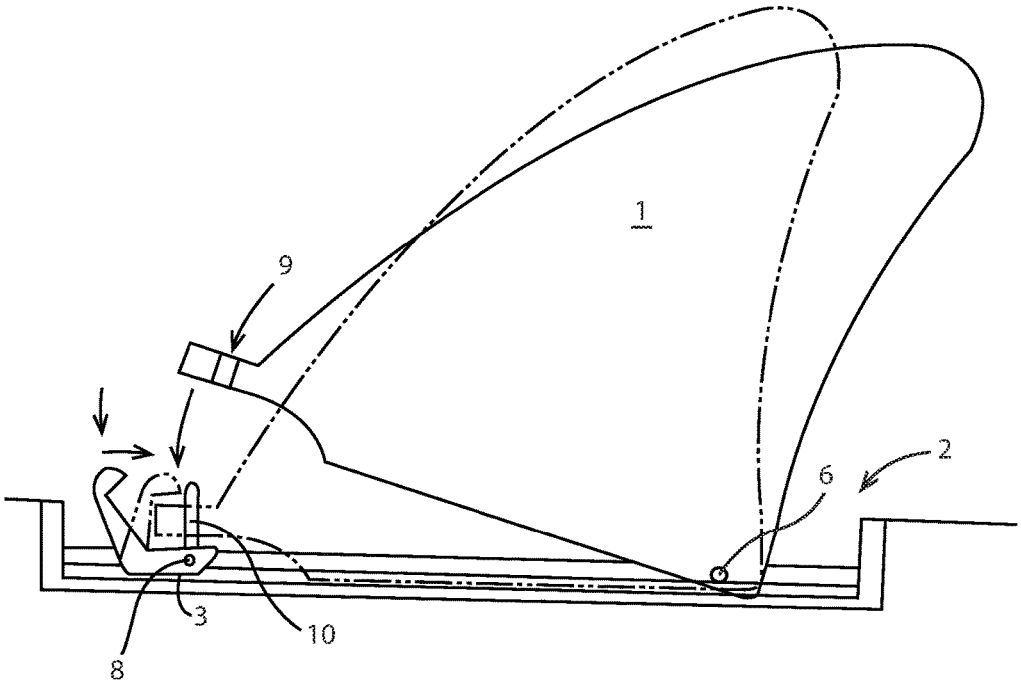
FIG. 11 shows a cutaway side view of a fin mounted into a standard fin box with another embodiment of the invention in an open and a closed position.

FIG. 11 shows a cutaway view of yet another embodiment of the present invention. In this embodiment, the retaining device 3 resides primarily within the fin box 2 with laterally extending members 8 for engaging the longitudinal slots 12 in the fin box 2 previously discussed. The locator post 10 may extend a bit beyond the fin box 2 to make it easier to locate in sometimes unfavorable conditions. Also, in this embodiment, there may be a hook member 22 hingeably connected to the locator post 10 either directly or by being connected to an intermediate body portion 20. The hook member 22 also may extend a bit beyond the fin box 2 to make it easy to manipulate by the user's finger or thumb. The end portion 23 of the hook 22 is configured and positioned to extend around and abut a portion of the tab portion 16 of the fin 1 to hold the fin 1 in place. It is hingeably connected to the locator post 10 or intermediate body member 20 so that the user can pull it away from the portion of the fin tab 16 that it abuts and thereby release the fin 1 from the fin box 2. FIG. 11 shows the hook member 22 in solid lines in the flexed position and in broken lines where it would reside when not being flexed away from the fin tab 16.

Figure 12:
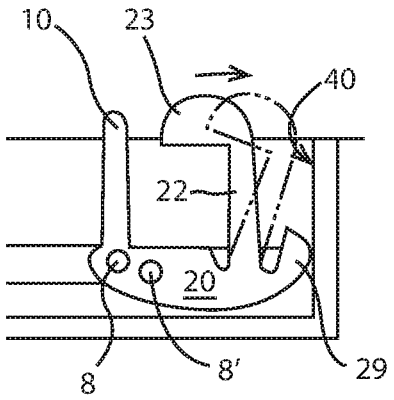
FIG. 12 shows a side view of another embodiment of the invention in a closed position.
Figure 13:
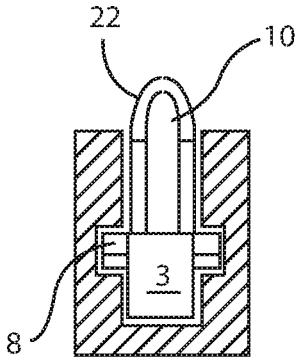
FIG. 13 shows a cross-sectional end view of the embodiment of FIG. 12 showing the cross members residing in slots in the sidewalls of a standard fin box.
Figure 14:
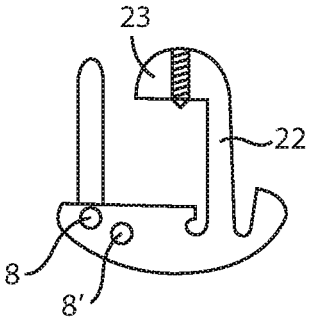
FIG. 14 shows a close up view of another embodiment of the present invention.

FIGS. 12 through 14 show another embodiment that has a flexible hook member 22. This embodiment includes an end spacer 29. The end spacer 29 insures that the retaining device 3 never ventures too close to the far end 40 of the fin box 2. As a result, spacer 29 insures that there is always at least enough longitudinal space for the hook member 22 to be flexed or moved away from the fin tab 2 surface to allow release of the fin 1.

Additionally, in FIG. 12, there are two laterally extending (or cross) members 8 and 8' per side with a diagonal offset to create a slight or significant "jam" in the sidewall slots or channels of the fin box 2 when the locator post 10 is engaged with vertical through hole 9 of the fin tab 16. That is, when locator pin 10 is engaged in the hole 9 in the fin tab 16, the diagonally placed cross members 8 and 8' bind against both the top and bottom surfaces of the horizontal channels 12 to help remove any vertical "slop" as well as any fore or aft movement of the fin 1 once it is securely retained in the fin box 2 and ready to be put to use. This configuration helps resist upward and rotational forces on the device 3.

FIG. 14 shows a similar embodiment in which there is a hole or recess 25 in the end portion 23 of the hook member 22. The hole or recess 25 is configured to receive a manipulation tool (not shown) to provide greater leverage for the user to move the hook member 22 between its flexed and relaxed positions. The hole 25 may also be threaded to allow the hole 25 to also receive a set screw, grub screw, or other such screw to be screwed down and contact a surface or receiving feature on the fin tab 16 to compensate for any manufacturing discrepancies in the vertical dimension of the fin tab 16 and thereby remove any play in the fin 1 when the fin 1 is being securely retained in the fin box 2.

Figure 15:
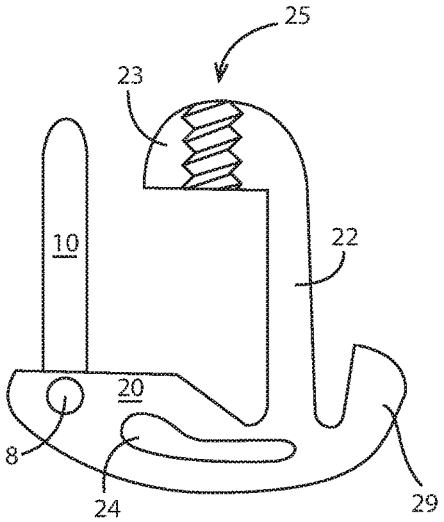
FIG. 15 shows a close up view of another embodiment of the present invention.

FIG. 15 shows another embodiment in which the connection between the hook member 22 and the body of the device 3 is hinged and yet resilient. In this configuration, there is an open space 24 between an upper region and the bottom edge of the intermediate body portion 20 of the retaining device 3. The region above the open space 24 can flex while the bottom edge of the device 3 continues to press against bottom of the fin box 2 whether the hook member 22 is being flexed or is in its relaxed position.

Figure 16:
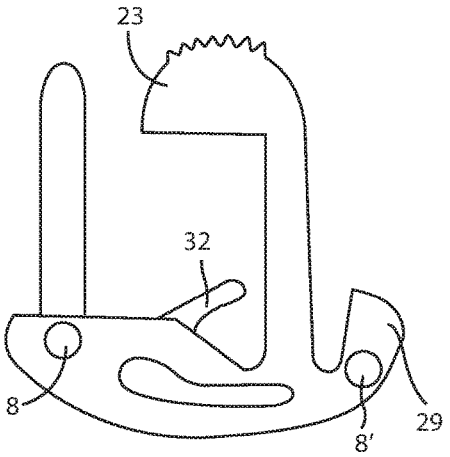
FIG. 16 shows a close up view of yet another embodiment of the present invention.

FIG. 16 shows an embodiment in which the top surface of the hook member 22 is serrated to increase the user's ability to pull the hook member 22 back with his or her finger or thumb to release the fin 1 from the fin box 2. FIG. 16 also shows a detent member 32 extending from the intermediate body portion 20 of the device 3 that applies a force on a surface of the fin tab 16 to remove or reduce the amount play experienced by the fin 1 while it is retained in the fin box 2.

Figure 17:
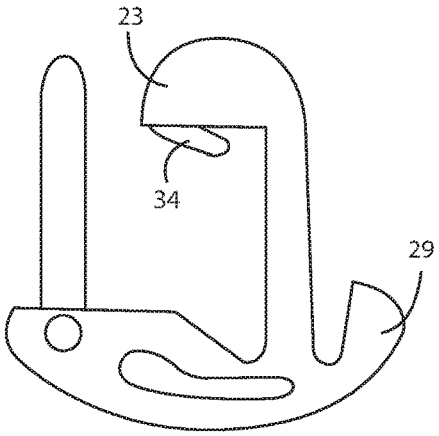
FIG. 17 shows a close up view of yet another embodiment of the present invention.

FIG. 17 shows a detent member 34 extending from the hook member 22 to apply a force on a surface of the fin tab 16 as yet another means of compensation for any discrepancies in fin manufacture. By pressing down on the top surface of the fin tab 16, this detent member 34 can, like the detent member 32 shown in FIG. 16, remove or reduce the amount play experienced by the fin 1 while it is retained in the fin box 2.

Figure 18:
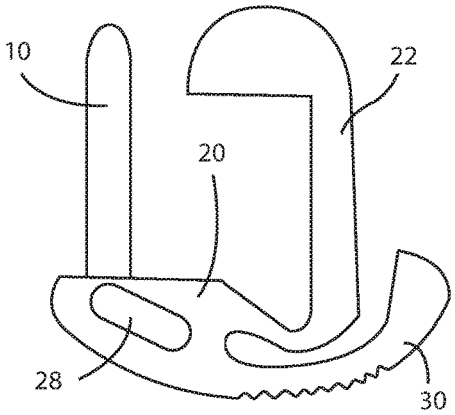
FIG. 18 shows a close up view of yet another embodiment of the present invention.

FIG. 18 shows yet another embodiment, this one with an elongate lever 30 along its bottom edge for strength as well as ease of flexation. FIG. 18 also shows a single, oblong pin 28, instead of the dual offset pins 8 and 8' of FIG. 12, as well as serrations at the bottom of at least to the elongate lever 30 to take advantage of the resilient properties of the elongate lever 30 and configuration to gain additional traction with the bottom surface of the fin box 2.

Some of the elements in the foregoing embodiments may be made from resilient, machinable plastic; molded; machined; extruded; or constructed using a combination of other materials and methods.

While the present invention has been described with regards to particular embodiments, it is recognized that additional variations of the present invention may be devised without departing from the inventive concept.

What is claimed is:

1. A device for releasably attaching a fin to a fin box of a watercraft comprising a body portion configured to reside primarily within the fin box, a substantially vertical post member connected to the body portion, at least one laterally extending member affixed to and extending from the body portion and configured to extend into at least one longitudinal slot formed in a sidewall of the fin box and configured to allow the device to slide longitudinally within the fin box while the post member remains in a substantially vertical orientation to receive a hole in the fin, and a hook member hingeably connected to the body portion and configured to extend around and abut a portion of the fin to hold the fin in place and configured to hingeably move away from said portion of the fin to release the fin from the fin box.

2. The device of claim 1 further comprising a detent member extending from either the body portion or the hook member to reduce the amount play for the fin when the fin is retained in the fin box.

3. A device for releasably attaching a fin to a fin box of a watercraft comprising a substantially vertical post member, a body portion connected to the post member, at least one laterally extending member connected to the post member and configured to extend into at least one longitudinal slot formed in a sidewall of the fin box and configured to allow the device to slide longitudinally within the fin box while the post member remains in a substantially vertical orientation to receive a hole in the fin, and a hook member hingeably connected to the post member and configured to extend around and abut a portion of the fin to hold the fin in place and configured to hingeably move away from said portion of the fin to release the fin from the fin box.

4. The device of claim 3 further comprising a second laterally extending member on the same side of the body portion as said at least one laterally extending member and offset therefrom to help reduce an amount of play as well as any tendency of the fin to move fore or aft movement once the fin is securely retained in the fin box.

5. The device of claim 3 wherein said at least one laterally extending member is oblong and slanted to help reduce an amount of play as well as any tendency of the fin to move fore or aft movement once the fin is securely retained in the fin box.

6. The device of claim 3 further comprising an elongate lever along a bottom edge of the body portion and configured to add strength and reduce any tendency of the body portion to flex.

7. The device of claim 3 further comprising a detent member extending from the body portion to reduce an amount of play for the fin when the fin is retained in the fin box.

8. The device of claim 3 further comprising a detent member extending from the hook member to reduce an amount of play for the fin when the fin is retained in the fin box.

9. The device of claim 3, further comprising an end spacer to insure that the body portion does not venture so close to a far end of the fin box to make it difficult for a user to hingeably move the hook member.

10. A method of releasably attaching a fin to a fin box of a watercraft comprising slipping at least one laterally extending member extending from a retaining device into a horizontal slot in the fin box such that a substantially vertical post member resides in said fin box and oriented substantially vertically, lowering a through hole in a tab portion of a detachable fin over the vertical post, securing said tab portion in the fin box so that the detachable fin is securely yet releasably attached to the watercraft, wherein the tab portion is secured by an end portion of a hook member that is hingeably connected to the vertical post member and wherein the end portion of the hook member is configured to extend around and abut a portion of a surface of said tab portion.

11. The method of claim 10 further comprising applying a force to the end portion of the hook member to move said end portion away from said tab portion of the fin to release the fin from the fin box.

12. The method of claim 10 further comprising slipping a second laterally extending member that is on the same side of the body portion as said at least one laterally extending member and offset therefrom into the horizontal slot in the fin box to help reduce an amount of play as well as any tendency of the fin to move fore or aft movement once the fin is securely retained in the fin box.

13. The method of claim 10 wherein said at least one laterally extending member is oblong and slanted to help reduce an amount of play as well as any tendency of the fin to move fore or aft movement once the fin is securely retained in the fin box.

14. The method of claim 10 wherein the retaining device has an elongate lever along a bottom edge of the retaining device that is configured to add strength and reduce any tendency of the body portion to flex.

15. The method of claim 10 further comprising reducing the amount play for the fin when the fin is retained in the fin box by applying a force of a detent member extending from a surface of the retaining device.

16. The method of claim 10, wherein the retaining device further comprises an end spacer to insure that the retaining device does not venture so close to a far end of the fin box to make it difficult for a user to hingeably move the hook member.

* * * * *